United States Patent [19]

Beghin

[11] Patent Number: 5,038,072

[45] Date of Patent: Aug. 6, 1991

[54] CONTACT DEVICE FOR THE PHOTOCATHODE OF PHOTOELECTRIC TUBES AND MANUFACTURING METHOD

[75] Inventor: Michel E. A. Beghin, Brive La Gaillarde, France

[73] Assignee: U.S. Philips Corporation, New York, N.Y.

[21] Appl. No.: 409,534

[22] Filed: Sep. 19, 1989

[51] Int. Cl.[5] ..... H01J 31/50; H01J 40/06

[52] U.S. Cl. ..... 313/370; 313/372; 313/524; 313/542; 350/96.27

[58] Field of Search ..... 313/370, 372, 373, 524, 313/541, 542, 544; 350/96.27

[56] References Cited

U.S. PATENT DOCUMENTS

| | | | |
|---|---|---|---|
| 2,719,241 | 9/1955 | Coltman | 313/373 X |
| 3,387,162 | 6/1968 | Schagen et al. | 313/544 |
| 3,712,986 | 1/1973 | Collings | 313/524 X |
| 4,264,408 | 4/1981 | Benham | 313/372 X |

*Primary Examiner*—Sandra L. O'Shea
*Attorney, Agent, or Firm*—John C. Fox

[57] ABSTRACT

Contact device for the photocathode of photoelectric tubes includes a metallic deposit of narrow conductive contacts on the photocathode substrate. The device is useful in image intensifier tubes and fast slot scanning cameras.

2 Claims, 3 Drawing Sheets

CONTACT DEVICE FOR THE PHOTOCATHODE OF PHOTOELECTRIC TUBES AND MANUFACTURING METHOD

BACKGROUND OF THE INVENTION

The present invention relates to a contact photocathode of photoelectric tubes produced by a metallic deposit on a substrate intended to receive the said photocathode. It also relates to a manufacturing method for such a contact device.

The invention has a particularly advantageous application in the field of fast image intensifying tubes and ultra-fast slot scanning camera tubes.

The technical problem to be solved for any photocathode contact device for photoelectric tubes, and particularly for fast and ultra-fast tubes, consists in obtaining a fast supply of electrons to the photocathode from the power supply of the tube in order to reduce the time constant RC associated with the photocathode, R being the resistance per unit area of the said photocathode. During operation, the photocathode in fact quickly exhausts itself of photo-electrons, such that it is absolutely essential, if it is desired to operate at high switching frequencies, to regenerate the electrons of the photocathode in a very short time. A known solution to this technical problem is to form a metallic deposit on a substrate intended to receive the said photocathode, for example a semi-transparent conductive sub-layer made from nickel, nickel-chrome, aluminium or palladium. The quantum efficiency of this known contact device is then limited, on the one hand, by the sensitivity of the photocathode itself and, on the other hand, by the optical transmission of the conductive sub-layer/substrate assembly. The thickness of this sub-layer is therefore chosen with the intention of providing a correct compromise between the resistivity of the assembly of the two layers (metal and photocathode) and the optical transmission of the sub-layer and of the photocathode. In other words, the thickness of the conductive sub-layer must be sufficient for its resistance per unit area to be rather low, (typically 100 to 500 Å), without however being so great that the quantum efficiency of the device would be unacceptably reduced. In practice, the necessity for this compromise prevents the obtaining of a contact device which is entirely satisfactory, particularly for ultra-fast tubes. Furthermore, this known type of contact device has the disadvantage, because of the relatively high resistivity of the conductive sub-layer, of efficiently injecting electrons only from the periphery of the photocathode.

OBJECTS AND SUMMARY OF THE INVENTION

One of the objects of the present invention is to provide a contact device for the photocathode of photoelectric tubes produced by metallic deposit on a substrate intended to receive the said photocathode, by means of which there is obtained both a high quantum efficiency and a low resistance per unit area, which makes possible the injection of electrons into the photocathode in a substantially uniform way over the entire useful area of the photocathode. cathode. Another object of the invention, for a particular embodiment in which the substrate is the end of a bundle of optical fibres having transparent areas of core glass and opaque areas of edge glass, is to avoid further reducing the transmission of the device which is already affected by the opacity of the edge glass areas.

According to the present invention, the contact device is formed by narrow conductive contacts deposited on the useful area of the substrate. Thus, by adjusting the width of the narrow conductive contacts, it is possible to obtain the desired overall transmission, while by giving them a sufficient thickness, the total desired resistance is produced. Furthermore, the injection of electrons takes place over the entire useful area of the photocathode and not preferentially on the periphery, which improves uniformity and further limits the response time because the time taken for the electrons to move to the different parts of the photocathode is reduced. In a particular embodiment, the narrow conductive contacts are metallic wires deposited on the edge glass areas. Because of this, the initial transmission of the device, associated with the edge glass areas, is not affected by the presence of the narrow conductive contacts.

According to another aspect of the invention, a method of manufacturing the contact device advantageously puts into practice the technique known as "lift off" and is notable in that there is deposited on the substrate a photopolymerizable resin which is then irradiated and developed in order to reveal the tracks of the narrow conductive contacts, and there is deposited over the entire useful area of the substrate a metallic layer, and then by means of an ultrasonic processing, the remaining resin and the portions of metallic layer situated outside of the tracks is removed, after which the phototcathode is deposited on the surface of the substrate.

BRIEF DESCRIPTION OF THE DRAWING

The following description with reference to the appended drawings, given by way of non-limiting example, will give a good understanding of what the invention of how it may be embodied.

DESCRIPTION OF THE PREFERRED EMBODIMENTS

Figure 1A:
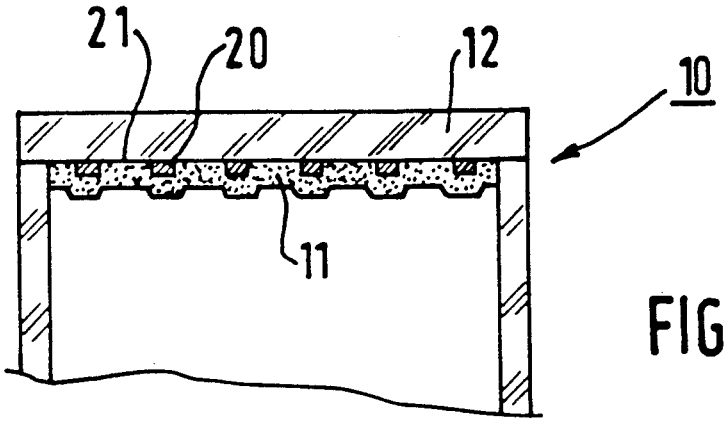
FIG. 1*a* a cross-sectional view of a first photocathode contact device according to the invention.
Figure 1B:
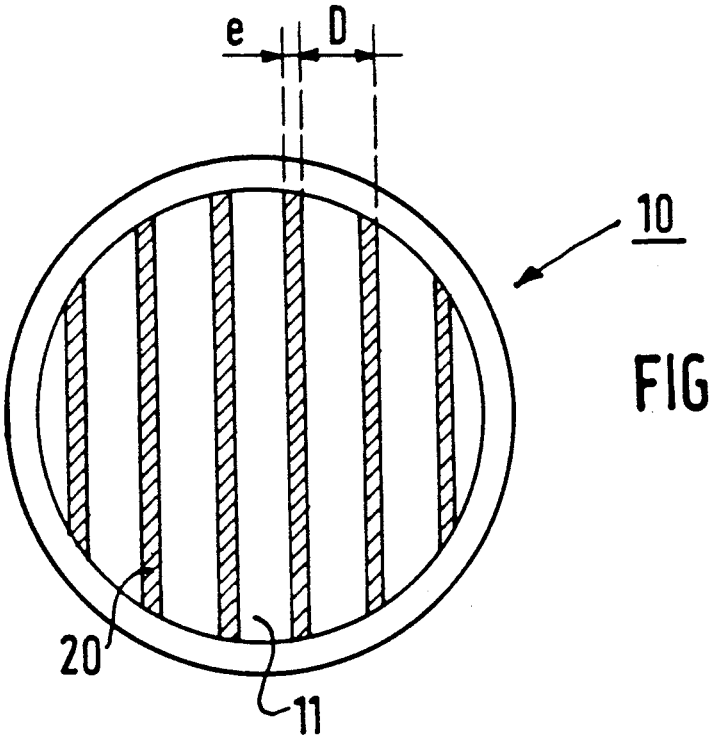
FIG. 1*b* is a plan view of the contact device of FIG. 1.

FIGS. 1*a* and 1*b* together show, in cross-section and in plan view, a contact device 10 for the photocathode 11 of photoelectric tubes produced by metallic deposit 20 on a substrate 12. As shown in FIGS. 1*a* and 1*b*, in a first embodiment, the deposit 20 is constituted by narrow conductive contacts 20 deposited on the useful area 21 of the substrate 12 which, in the case of FIGS. 1*a* and 1*b*, is a glass window. These narrow conductive contacts 20 are connected to the electrical power supply of the photoelectric tube including the said contact device 10. In order to reduce the electrical resistance of the contact device 10 and to increase the speed of the electron exchanges with the photocathode 11, it is possible to give the narrow conductive contacts 20 a thickness which is substantially greater, ten times for example, than the thickness of the metallic sub-layers normally used in the prior art, which must retain sufficient transparency. In this case, the transmission through the narrow conductive contacts 20 themselves is practically zero, such that the optical transmission of the contact device is determined by the ratio between the useful area of the substrate 12 occupied by the narrow conductive contacts 20 and the total useful area of this substrate on which the contacts 20 have been deposited. In the case in which, as shown in FIGS. 1*a* and 1*b*, the narrow conductive contacts 20 are equidistant parallel wires, the transmission of the device is governed by the ratio between the width e of these wires and the distance D between two consecutive wires. Thus, for a width e of 10 Åm and a distance D of 100 Åm, the optical transmission of the device will be 90%, while, for the known semitransparent sub-layers, it is in the order of 60 to 70%, these values being obtained for example for a palladium layer of approximate thickness 50 A.

Figure 2A:
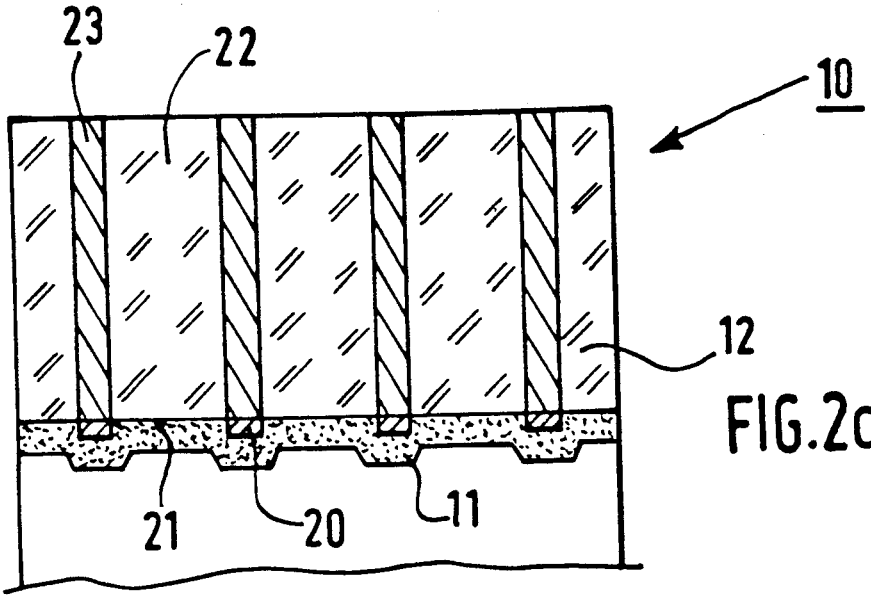
FIG. 2*a* is a cross-sectional view of a second contact device according to the invention.
Figure 2B:
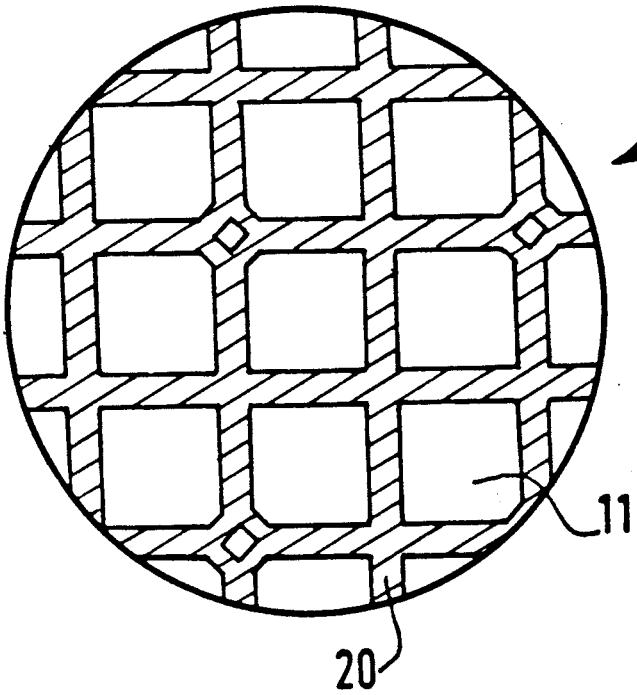
FIG. 2*b* is a plan view of the contact device of FIG. 2*a*.

FIGS. 2*a* and 2*b* show a second embodiment of a contact device 10 in which the substrate 12 is the end of a bundle of optical fibres having transparent core glass areas 22 and opaque edge glass areas 23. In this particular embodiment, the narrow conductive contacts 20 are metallic wires deposited on the edge glass areas 23. The contact device 10 does not then cause any reduction in transmission.

Figure 3:
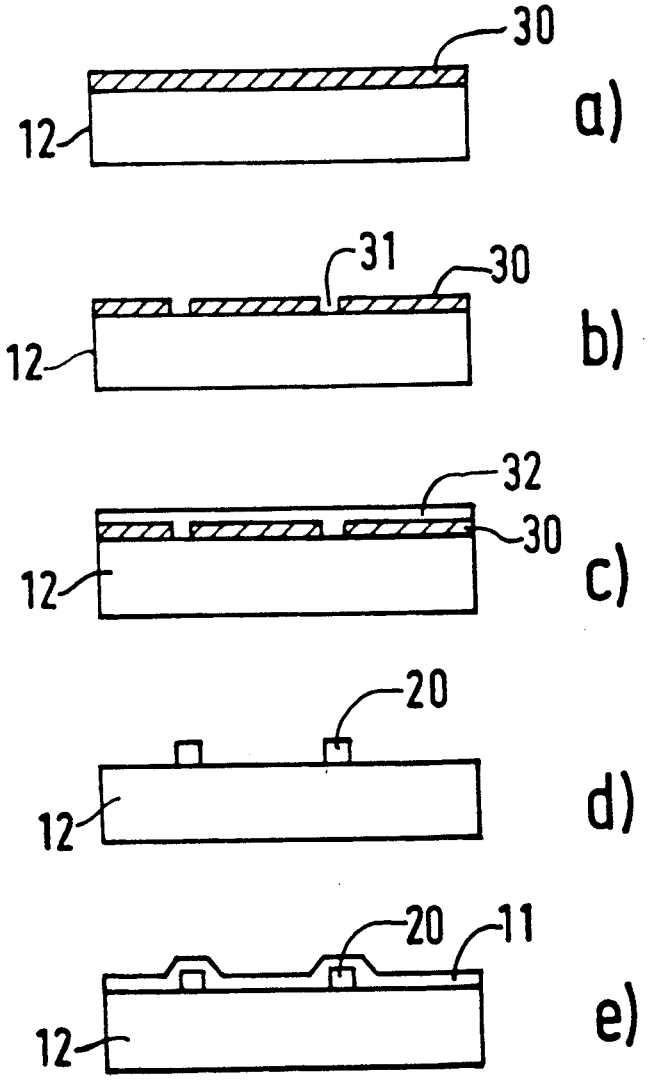
FIG. 3 illustrates by successive cross-sectional views a manufacturing method for a contact device according to the invention.

FIG. 3 shows the various stages of a method of producing the contact devices described with reference to the FIGS. 1*a*, 1*b*, 2*a* and 2*b*. According to this method, there is deposited on the substrate 12 a photopolymerizable resin 30 (FIG. 3*a*) which is then irradiated and developed in order to expose the tracks 31 for the narrow conductive contacts 20 (FIG. 3*b*). Where the substrate 12 is a glass window, a positive photo-polymerizable resin 30 is used and is irradiated through a mask reproducing the tracks 31. On the other hand, if the substrate is the end of a bundle of optical fibres (FIGS. 2*a* and 2*b*), a negative resin is used and is irradiated without a mask through the bundle of optical fibres itself. There is then deposited, over the entire useful area of the substrate 12, a metallic layer which cna reach a thickness of several hundred Angstroms (FIG. 3*c*). Then, by means of a process using ultrasonics and acetone known as the "lift of" method, the remaining resin and the portions of metallic layer 32 situated outside of the said tracks 31 is removed in order to leave on the surface of the substrate 12 only the narrow conductive contacts 20 (FIG. 3*d*). The metals used for forming the metallic layer 32 are those which make a good bond with the glass and which do not pollute the photocathodes, such as gold, palladium, nickel-chrome mixture. In a final operation (FIG. 3*e*), the photocathode is deposited on the surface of the substrate 12.

I claim:

1. Contact device for the photocathode of photoelectric tubes including a metallic deposit on a substrate intended to receive the said photocathode, the metallic deposit being formed by narrow conductive contacts deposited on a useful area of the substrate, wherein the substrate is the end of a bundle of optical fibers having transparent areas of core glass and opaque areas of etched glass, and the narrow conductive contacts are deposited on the etched glass areas.

2. Contact device according to claim 1, wherein the substrate is a glass window, and the said narrow conductive contacts are substantially parallel and substantially equidistant metallic wires.

* * * * *